United States Patent [19]

Evans

[11] 4,032,010

[45] * June 28, 1977

[54] MARKER ASSEMBLY

[75] Inventor: Joseph H. Evans, Palo Alto, Calif.

[73] Assignee: Raychem Corporation, Menlo Park, Calif.

[ * ] Notice: The portion of the term of this patent subsequent to July 15, 1992, has been disclaimed.

[22] Filed: July 23, 1975

[21] Appl. No.: 598,412

Related U.S. Application Data

[60] Continuation-in-part of Ser. No. 580,596, May 27, 1975, which is a division of Ser. No. 369,836, June 14, 1973, Pat. No. 3,894,731.

[52] U.S. Cl. ..... 206/345; 206/493; 206/390; 269/47; 264/230; 40/316

[51] Int. Cl.² ..... B65D 85/20

[58] Field of Search ..... 206/493, 390, 345, 338

[56] References Cited

UNITED STATES PATENTS

| | | | |
|---|---|---|---|
| 3,227,270 | 1/1966 | Floyd, Jr. | 206/338 |
| 3,894,731 | 7/1975 | Evans | 269/47 |

*Primary Examiner*—William Price
*Assistant Examiner*—Douglas B. Farrow
*Attorney, Agent, or Firm*—Lyon & Lyon

[57] ABSTRACT

A carrier having substantially flat projections which extend from the carrier to snugly and slidably bear heat recovered sleeves thereby conforming to the flattened configuration of the projections. After positioning generally tubular heat recoverable sleeves over the projections and partial recovery of the same, printed information may be easily imparted to the sleeves on a modified typewriter or the like. The sleeves may then be removed from the projections and employed as identifying markers for electrical wire or other like articles to be marked. The sleeves may be further heat recovered in position on the marked article to snugly fit thereon.

5 Claims, 17 Drawing Figures

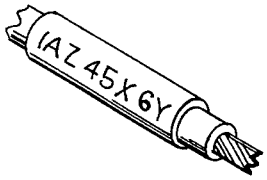
FIG. 6
FIG. 7
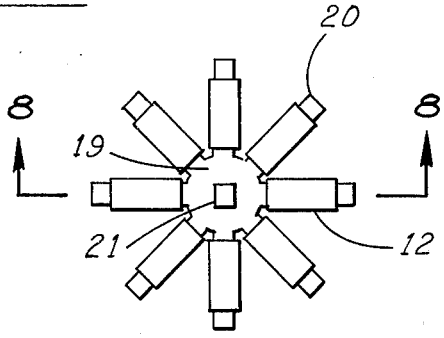
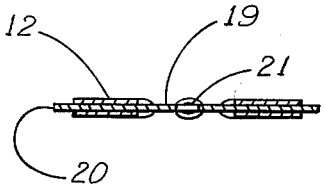
FIG. 8
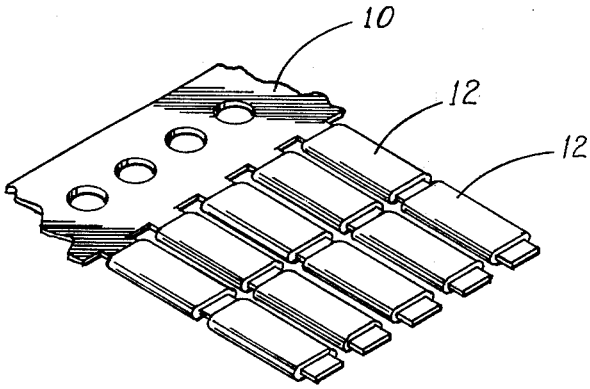
FIG. 9
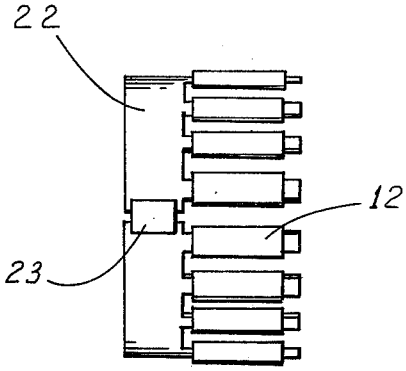
FIG. 10
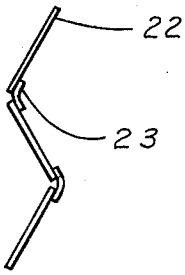
FIG. 11
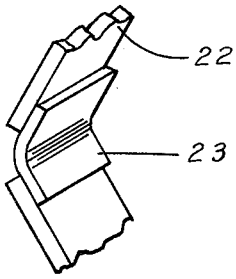
FIG. 12

FIG. 13
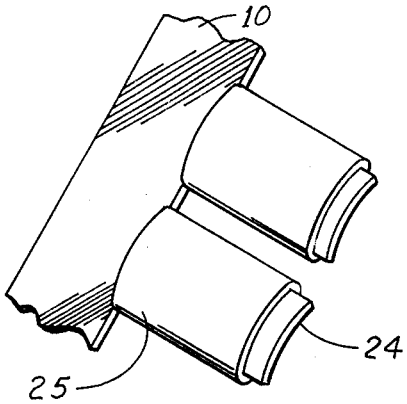
FIG. 14
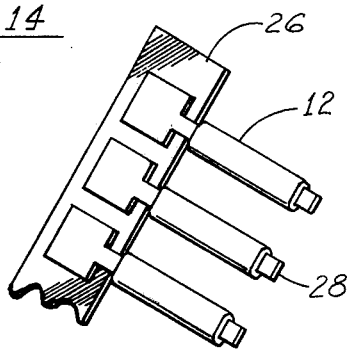
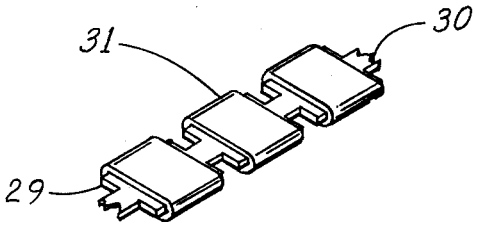
FIG. 15
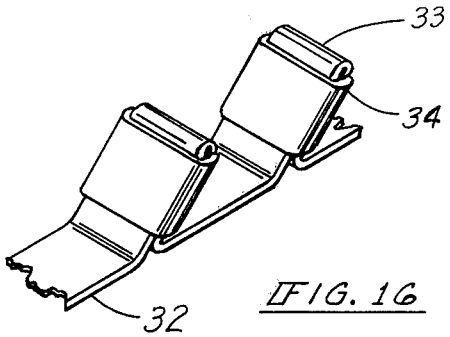
FIG. 16
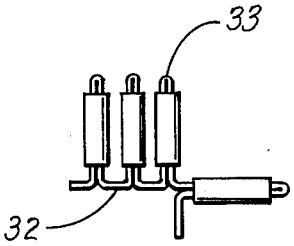
FIG. 17

MARKER ASSEMBLY

CROSS REFERENCE TO RELATED APPLICATION

This is a continuation-in-part of application Ser. No. 580,596, filed May 27, 1975, which is a divisional application of Ser. No. 369,836, filed June 14, 1973, issued as U.S. Pat. No. 3,894,731.

BACKGROUND OF THE INVENTION

The present invention is directed to markers for electrical wire and the like for identification purposes. More specifically, the present invention is directed to a marker assembly including conveniently mounted marker sleeves for use in marking electrical wire and the like.

Industry finds frequent need for identifying markers employed in tagging components of complicated assemblies. This is particularly so in the case of complex electrical assemblies such as, e.g., wiring systems employed in aircraft and the like. In such cases, the practice heretofore has been to impress identifying characters into the insulation of electrical conductors, an expedient which risks impairment of insulative integrity. More recently, it has become common to impress or print identifying information onto plastic tubes which are then slipped over the opposite ends of electrical conductors, permitting their tracking when combined with other such conductors in a cable bundle. That process, proceeding as it does on a substantially piecemeal basis, has proved undesirably laborious and, in addition, the dimensional tolerance required for facile addition of the tubular markers to electrical conductors has permitted their free movement on the conductor, so as to require a sharp bend in the wire end to prevent loss of the marker during handling of the free conductor.

Conceivably, the problems of piecemeal printing on wire markers and the like could be alleviated to a degree by a "ticker tape" approach in which a tube was flattened and fed through a typewriter. However, such a system would require extensive typewriter feed system modifications. Moreover, the type, ribbon and platen of a conventional typewriter are designed to make clean impressions on relatively hard, smooth surfaces. In the case of a merely flattened tube, the keys would strike a double layer of soft plastic separated by a small air gap, likely resulting in fuzzy, multiple impressions with standard type mechanisms. Again, by the ticker tape route, the markers are attached in order end to end, so that only the markers at the ends of any given group would be available for installation. Moreover, care would be required to prevent a twist in the tube during the typing since any twist would cause the type to spiral about the tube. With the ticker tape tube designed to be heat-shrinkable for minimum bulk installation on a wire or cable, it would not be susceptible to radiant heating to render indelible printed characters thereon, because that heating would prematurely effect heat recovery. Finally, such a tubular marker, unless made heat recoverable would continue to pose the retention problem previously alluded to, i.e., the necessity that wire ends be bent to prevent loss during handling after marker application.

Until the present invention, a need existed for a marker system free of the foregoing problems.

SUMMARY OF THE INVENTION

According to this invention there is provided an assembly and a method for forming such an assembly, the assembly comprising a carrier having projections spaced one apart from another, and a plurality of flattened tubular plastic sleeves snugly and slidably disposed over the projections so as to permit removal therefrom when drawn past the ends of the projections away from the carrier. The sleeves either are partially or fully heat recovered onto the projections, assuming their flattened configuration so as to present a flat surface to a printing mechanism such as typewriter key, which key is enabled to leave on the sleeve surface a clear impression by reason of the backstop provided during typing by the carrier. The heat recovered sleeves retain their flattened configuration when removed from the projections of the carrier. However, when pressure is applied from their opposite sides, they open out to receive a wire. Release of pressure causes the information-bearing sleeve to attempt to reassume its flattened configuration, so that the marker sleeve grips the wire about which it has been disposed much in the manner of a spring clip. If the sleeves have been only partially heat recovered onto the projections, heat may again be applied to the sleeve in its desired position on the marked article to cause the sleeve to tightly fit thereon.

Accordingly, an object of the present invention is to provide a convenient marker sleeve assembly.

Another object of the present invention is to provide a marker sleeve assembly including carrier borne marker sleeves.

It is a further object of the present invention to provide a method for creating a carrier-marker sleeve assembly.

The manner in which these and other objects and advantages of the invention are achieved will become clear from the description of preferred embodiments which follows and from the accompanying drawing.

BRIEF DESCRIPTION OF THE DRAWINGS

FIG. 6 is a perspective view of a marker sleeve formed according to the present invention which has been heat recovered on a marked article.

FIG. 7 is a plan view of a second embodiment of the present invention.

FIG. 8 is a cross-sectional elevation taken along line 8—8 of FIG. 7.

FIG. 9 is a partial, perspective view of another embodiment of the present invention.

FIG. 10 is a plan view of a further embodiment of the present invention.

FIG. 11 is an end view of the embodiment of FIG. 10.

FIG. 12 is a partial, perspective view illustrating the hinge detail of the embodiment of FIG. 10.

FIG. 13 is a partial, perspective view of yet another embodiment of the present invention.

FIG. 14 is a partial, perspective view of a further embodiment of the present invention.

FIG. 15 is a partial, perspective view of yet another embodiment of the present invention.

FIG. 16 is a partial, perspective view of yet another embodiment of the present invention.

FIG. 17 is an elevation view of another embodiment illustrating a modification of the embodiment of FIG. 16.

DETAILED DESCRIPTION OF THE INVENTION

Figure 1:
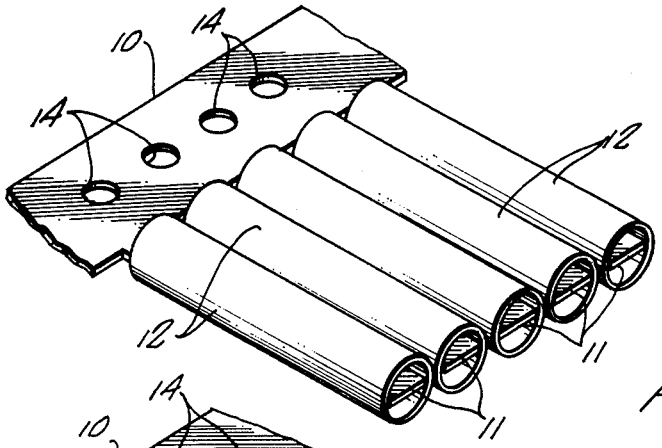
FIG. 1 is a partial, perspective view of an assembly according to one embodiment of this invention prior to heat recovery of the sleeves about appendages of a supporting carrier.
Figure 2:
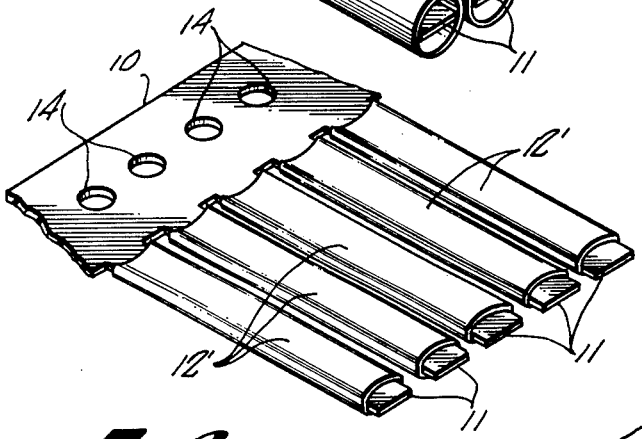
FIG. 2 is a perspective view of the assembly of FIG. 1 following heat recovery of the sleeves.

With reference first to FIGS. 1 and 2, a carrier 10 is provided which includes a belt from one side of which project a plurality of flat projections or tines 11 spaced one apart from another. Alternatively, of course, projections could extend from each side of the carrier, facilitating typing of identical information on the so aligned sleeve pairs borne by the oppositely extending projections. Heat recoverable sleeves 12 are disposed over individual ones of projections 11. Preferably, a release agent is disposed between the sleeves and projections, as by dip-coating the projections in such an agent or by coating with such an agent the interior of a tubular member from which sleeves 12 are later cut. As appears from FIG. 2, upon heat recovery of the sleeves, the recovered sleeves 12 snugly and slidably conform to the flattened configuration of the projections 11, while admitting of ready removal therefrom when drawn past the ends of the projections distant from the carrier 10.

Figure 3:
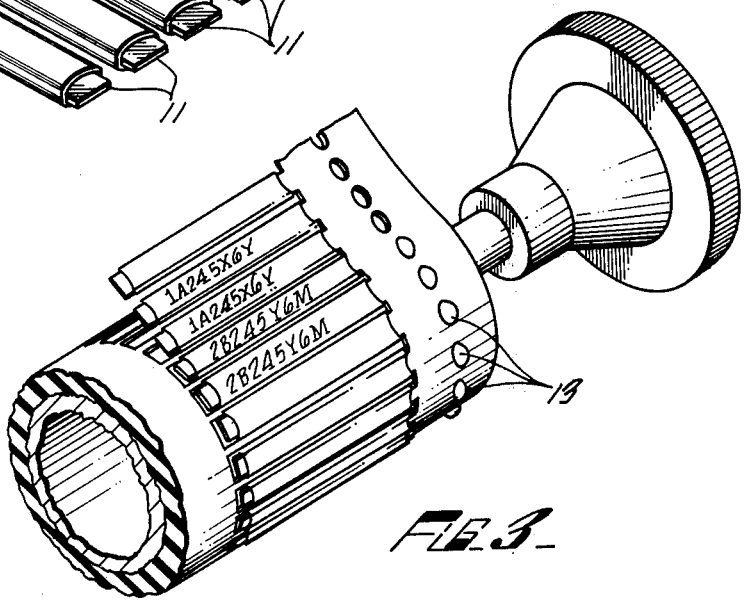
FIG. 3 is a partial, perspective view of a typewriter platen bearing an assembly like that of FIG. 2 in the course of the addition of printed information thereto.

One advantage of this invention is that the carrier-sleeve assembly admits of facile impartation of printed information to the sleeves. FIG. 3 depicts the platen of a conventional typewriter modified essentially only in that indentations have been cut into the hard rubber surface of the platen to receive and position the sleeves for presentation to the typewriter keys (additionally, if desired as an aid in registration, the platen may be provided with a sprocket wheel whose teeth 13 engage a train of perforations 14 disposed along the length of the carrier 10). Thus, with but minor modification, a conventional typewriter platen can be ideally configured for rapid printing of identifying information on the marker sleeve assembly. The unindented portion of the platen can be used for conventional typing or an unmodified platen substituted by the typist whenever conventional typing is called for.

Typically, the heat absorptive characteristics of the dark printed characters will be such as to permit their being rendered indelible by exposure to radiant heat, all without unduly discoloring the surrounding, printed portions of the flattened surface. Thus, once printed indicia are added to the marker assembly, the same can be conveyed past, for example, an infrared source, effectively and indelibly "burning" the characters into the substance of the sleeve.

The unrecovered sleeves 12 may be manufactured so as to "remember" an interior circumferential dimension on the order of twice the width of projection 11 so that while recovery results in a snug disposition of the sleeves over the projection, the sleeves do not tend to substantially further recover when freed of the projections and raised to their recovery temperature. In particular instances where it is desired that the marker sleeve once free of its projection support and disposed over a wire or the like be heat recoverable to a low profile configuration, that may be done simply by appropriate sleeve dimensioning prior to impartation of heat recoverability. In such cases, the tendency of sleeves recovered about the projections to attempt further recovery when subjected to radiant heat in course of rendering indelible their printed indicia is thwarted by the projections themselves.

Generally, the unrecovered sleeves are recoverable to an interior circumferential dimension ranging from about the width of the projections 11 to twice their width, depending upon whether one wishes further recovery once the sleeve is disposed about a wire.

Figure 4:
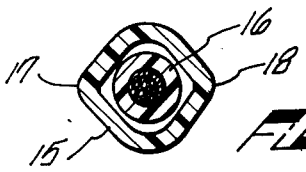
FIGS. 4 and 5 are end views of an electrical conductor and respectively illustrate the retentive "spring-action" of marker sleeves formed according to this invention.
Figure 5:
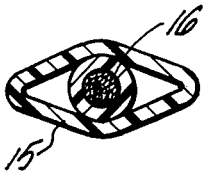

FIGS. 4 and 5 illustrate the retentive spring-action of a marker sleeve 15 prepared according to the invention when disposed about an electrical conductor 16. With reference to FIG. 4, imposition of pressure on opposite edges 17 and 18 of the sleeve causes its mid-portions to bow out, permitting ready insertion of conductor 16. When pressure is released, the flexible sleeve clamps the conductor 16 so that while on the one hand it is retained during handling of conductor 16, on the other it may be readily rotated about the conductor to present the identifying information it bears to whatever direction. FIG. 6 illustrates the heat recovery of a marker sleeve 12 to a snug position about conductor 16.

The carrier material is chosen to withstand exposure to the temperature of sleeve recovery and in the case where it is desired that sleeves be further heat recoverable when removed from their projection supports, is made sufficiently rigid as to withstand recovery forces without substantial deflection. At the same time, it is preferred that the materials be sufficiently flexible as to admit of disposition about the platen of a conventional typewriter in the embodiment of FIGS. 1 through 3. In the case where the sleeves borne by the support are to be exposed to relatively greater temperatures in order to render printed characters thereon indelible, the support preferably has a high heat deflection temperature. However, as discussed infra, most of that portion of the support not covered by the sleeves recovered thereon is heat-shielded during the indelibilization process, so that the support does not "see" temperatures of the magnitude "seen" by the exposed sleeve surface. The preferred support material is nylon 66, although those skilled in the art will readily appreciate that many other materials may be used, e.g., stiff cardboard, flexible metal stock, etc. The projections are preferably integral with the carrier element of the support, and in such a case the carrier is cut from sheet stock in a direction insuring that any burrs are directed away from that surface adjacent the recovered sleeve surface upon which printing is to be effected. Otherwise, it may be that, in the course of typing, portions of the sleeve will be "impaled" on the burrs, making removal of the sleeve from its supporting projection somewhat difficult.

As before noted, the release agent may be coated on the carrier or alternatively coated on the interior of the sleeves. Where a lubricious release material is used, preferably it is one which either is not volatilized during indelibilization or one whose volatile by-products are not harmful. Preferred as a release agent or lubricant is a mixture of 95 parts by weight trichloroethane and 5 parts by weight silicone stopcock grease such as that available from the Dow Corning Corporation.

The heat recoverable sleeves of the invention are formed from material comprising polymeric material capable of having plastic or elastic memory imparted thereto. Materials having such memory have been dimensionally changed from an original heat stable configuration to a dimensionally heat unstable configuration tending to move in the direction of the original configuration upon the application of heat alone. The terms "plastic memory" and "elastic memory" are used interchangeably herein and are intended to be mutually inclusive.

Examples of such heat recoverable materials are found in Currie, U.S. Pat. No. 2,027,962, Cook et al., U.S. Pat. No. 3,086,242, and Clabburn, U.S. Pat. No. 3,721,749. The disclosures of which are incorporated herein by reference. One method of making a heat recoverable material consists in exposing a thermoplastic material to an amount of heat which is insufficient to allow the material to melt but sufficient to allow the molecular structure to become distorted; and then distorting the material to a new configuration and cooling the material in its distorted state. Subsequent increases in temperature sufficient to reduce locked-in stresses caused by the initial plastic deformation will cause the article to tend to recover to its initial state.

Another manner in which heat recoverable articles are generally made involves the formation of a polymeric article having a first dimension, followed by crosslinking of the polymer. The crosslinking can be effected by chemical means, e.g., with peroxides, or by irradiation or by combinations of the two. Radiation employed can be of various types including charged particles, i.e., beta and alpha, neutral particles, i.e., neutrons, and electromagnetic, i.e., gamma and ultraviolet, as is well known. Subsequent heating of the material will melt the crystals in a crystalline thermoplastic material or significantly lessen other internal molecular forces such as hydrogen bonding or dipoledipole interactions to an extent sufficient to allow distortion of the product. Upon cooling of the heated and distorted article, there is obtained a product which remains in its distorted shape while at room temperature, due to the reformation of strong interchain forces such as crystallinity which at low temperatures dominate the contrary stresses resulting from crosslinking. Upon reheating, the crosslink forces become dominant and the material tends to recover to its original geometry.

When irradiation is used, doses of any desired amount can be used although, generally, a dosage of from 5 to 50, preferably 20–25 megarads will be sufficient.

As exemplary of the polymeric materials to which heat recoverability can be imparted by the above and other means may be mentioned polyolefins such as polyethylene, polybutene, various copolymers of ethylene, propylene and butene, polyvinyl halides, e.g., polyvinyl chloride; ionomers and polyurethanes.

For optimal printability, the polymeric material of which the recoverably sleeve is formed contained a substantial proportion of filler material. The preferred sleeve material contains 40 parts by weight low density polyethylene, 15 parts by weight ethylene-ethylene acrylate copolymer, 8 parts by weight white pigment, 31 parts by weight flame retardant, and 6 parts by weight antioxidant. The recovery temperature of a sleeve so composed is on the order of about 105° – 110° C.

Typewritten information contained on sleeves formed of the foregoing preferred composition was indelibilized by exposing the support-borne sleeves to a quartz tungsten filament lamp for a short period (e.g., approximately 0.7 seconds) during which time the temperature of the print portions of the sleeves is believed to have been raised to ca. 315° C. Where this preferred additional step of the printing process is practiced, those skilled in the art of plastics printing are well able to determine what times and temperatures will suffice for whatever plastic material.

Turning to the alternate embodiments illustrated in FIGS. 7 through 17, FIGS. 7 and 8 disclose a carrier 19 which is in the shape of a circular disc with radial projections 20 extending to bear the marker sleeves 12. A hole 21 is centrally provided in the carrier 19 for retaining and manipulating the assembly. The hole 21 is shown to be other than circular in order that the carrier may be indexed about an axis extending through said hole 21. The carrier may again by nylon 66 or material of a stiffer nature.

FIG. 9 illustrates the loading of more than one sleeve per projection. This arrangement may be used to facilitate the marking of the same component with two or more sleeves bearing an identical number.

FIGS. 10, 11 and 12 illustrate as assembly including rigid carriers 22 hinged together at 23. The rigid carriers 22 may be of any convenient length such that the entire assembly may be folded for transportation and storage. The hinge 23 may be of any common type; a flexible single piece plastic hinge is illustrated here. Special typewriters have been found to be available for typing on rigid, flat surfaces such as the individual carriers 22 of the embodiment of FIGS. 10, 11 and 12.

FIG. 13 illustrates yet another embodiment where the projections 24 are curved about an axis of curvature oriented parallel to the direction of the projection 24. In this way, sleeves 25 are forced to assume a curved configuration when heat recovered around the projections 24. The advantage to having such arcuate projections 24 is that the projections 24 will fit against the cylindrical platen of a typewriter. Naturally, the radius of curvature should be similar to the radius of a cylindrical platen.

FIG. 14 illustrates a further embodiment of the present invention including a carrier 26 wherein projections 28 are separately provided and are conveniently affixed to the carrier 26 by such means as a mastic or the like. In this way the pitch of the projections may be varied and different sleeves may more easily be provided to the carrier already on the projection 28 from separate sources.

FIGS. 15, 16 and 17 illustrate embodiments where relatively large marker sleeves are loaded on a carrier. In FIG. 15, projections 29 extend on either side of the carrier 30 as a means for increasing the lateral dimension of the carrier 30. The sleeves are positioned around the wide portions of the carrier and heat recovered into a flat condition. The carrier 30 may them be fed through a typewriter and the printed indicia placed in a line perpendicular to the hole through the sleeve 31. To remove the sleeve 31 from the carrier 30, the carrier 30 may be readily severed between protrusions 29 and the sleeves 31 then removed by drawing each sleeve 31 along the carrier past the severed portion thereof.

In FIG. 16, the carrier 32 is folded to provide the projections 33 for receipt of sleeves 34. Again, such a system is advantageous for use with large sleeves 34 allowing the printing by a typewriter to be accomplished along a line perpendicular to the hole through the sleeve. The embodiment in FIG. 16 allows the projections 33 to be folded against the main path of the carrier 32 for typing of indicia and convenient packaging. If such a system is desired, it is beneficial to have the pitch of the projections 33 be at least as great as the length of each projection 33. In this way, the sleeves may fold against intermediate portions of the carrier 32 without interfering with each succeeding sleeve.

FIG. 17 illustrates a modification of the embodiment of FIG. 16 in that the intermediate carrier portions between succeeding projections 33 are reduced to a minimum allowing only a section necessary to create a proper hinge between succeeding projections 33. As in FIG. 16, the carrier 32 is made from one continuous strip of material. The embodiment in FIG. 17 is most convenient for storage but is not convenient for being printed upon by a conventional typewriter.

Thus, a number of embodiments are disclosed for accomplishing a marker assembly. These various assemblies find great utility in the rapid printing of indicia thereon and the facility with which the sleeves may be removed for positioning on a marked article. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. An assembly comprising a carrier, said carrier including a base and projections extending from said base; and a plurality of tubular sleeves, said sleeves being snugly and slidably disposed over said projections so as to admit of removal of said projections when drawn past the ends thereof, said sleeves being of heat recoverable material and dimensionally unstable on said projections such that said sleeves are heat recoverable to a lesser transverse dimension when removed from said projection.

2. An assembly according to claim 1 wherein said base is an elongated flexible member and said projections extend transversely from at least one side of said base in a train of substantially parallel tines spaced one apart from the other, said base admitting of flexure so as to diminish the distance between opposite ends thereof while retaining said projections in mutually parallel orientation.

3. An assembly according to claim 1 wherein said projections are arcuate about an axis of curvature oriented parallel to the direction of said projections.

4. The assembly according to claim 3 wherein said arcuate projections define a radius of curvature substantially equal to the radius of curvature of a typewriter platen.

5. An assembly comprising a carrier, said carrier including a flexible, elongated base and projections extending from one side of said base, said base admitting of flexure so as to diminish the distance between opposite ends thereof while retaining said projections in mutually parallel orientation, said projections being arcuate about an axis of curvature oriented parallel to the direction of said projections; and a plurality of tubular sleeves, each of said sleeves being snugly and slidably disposed over one of said arcuate projections so as to admit of removal from said projections when drawn past the ends thereof.

* * * * *